US008706483B2

(12) United States Patent
Gerl et al.

(10) Patent No.: US 8,706,483 B2
(45) Date of Patent: Apr. 22, 2014

(54) PARTIAL SPEECH RECONSTRUCTION

(75) Inventors: Franz Gerl, Neu-Ulm (DE); Tobias Herbig, Ulm (DE); Mohamed Krini, Ulm (DE); Gerhard Uwe Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 849 days.

(21) Appl. No.: 12/254,488

(22) Filed: Oct. 20, 2008

(65) Prior Publication Data

US 2009/0119096 A1 May 7, 2009

(30) Foreign Application Priority Data

Oct. 29, 2007 (EP) ..... 07021121

(51) Int. Cl.
*G10L 21/00* (2013.01)

(52) U.S. Cl.
USPC ..... 704/228; 704/226; 704/227

(58) Field of Classification Search
USPC ..... 704/226–228
See application file for complete search history.

(56) References Cited

U.S. PATENT DOCUMENTS

| | | | | |
|---|---|---|---|---|
| 5,165,008 | A * | 11/1992 | Hermansky et al. | 704/262 |
| 5,615,298 | A * | 3/1997 | Chen | 704/228 |
| 5,623,575 | A * | 4/1997 | Fette et al. | 704/265 |
| 6,026,360 | A * | 2/2000 | Ono | 704/260 |
| 6,055,497 | A * | 4/2000 | Hallkvist et al. | 704/228 |
| 6,081,781 | A * | 6/2000 | Tanaka et al. | 704/268 |
| 6,138,089 | A * | 10/2000 | Guberman | 704/207 |
| 6,499,012 | B1 * | 12/2002 | Peters et al. | 704/256.4 |
| 6,584,438 | B1 * | 6/2003 | Manjunath et al. | 704/228 |
| 6,725,190 | B1 * | 4/2004 | Chazan et al. | 704/205 |
| 6,826,527 | B1 * | 11/2004 | Unno | 704/223 |
| 6,910,011 | B1 * | 6/2005 | Zakarauskas | 704/233 |
| 6,925,435 | B1 * | 8/2005 | Gao | 704/220 |
| 7,117,156 | B1 * | 10/2006 | Kapilow | 704/267 |
| 7,308,406 | B2 * | 12/2007 | Chen | 704/262 |
| 7,313,518 | B2 * | 12/2007 | Scalart et al. | 704/226 |
| 7,392,180 | B1 * | 6/2008 | Accardi et al. | 704/223 |
| 7,702,502 | B2 * | 4/2010 | Ricci et al. | 704/205 |
| 7,720,681 | B2 * | 5/2010 | Milstein et al. | 704/244 |
| 2003/0046064 | A1 * | 3/2003 | Moriya et al. | 704/201 |
| 2003/0088414 | A1 * | 5/2003 | Huang et al. | 704/246 |

(Continued)

FOREIGN PATENT DOCUMENTS

WO WO 03/107327 12/2003

OTHER PUBLICATIONS

Hänsler, E. et al., *Audio Echo and Noise Control: A Practical Approach*, John Wiley & Sons, New York, New York, USA, copyright 2004, pp. 1-441.

(Continued)

*Primary Examiner* — Douglas Godbold
(74) *Attorney, Agent, or Firm* — Daly, Crowley, Mofford & Durkee, LLP

(57) ABSTRACT

A system enhances the quality of a digital speech signal that may include noise. The system identifies vocal expressions that correspond to the digital speech signal. A signal-to-noise ratio of the digital speech signal is measured before a portion of the digital speech signal is synthesized. The selected portion of the digital speech signal may have a signal-to-noise ratio below a predetermined level and the synthesis of the digital speech signal may be based on speaker identification.

23 Claims, 8 Drawing Sheets

(56) References Cited

U.S. PATENT DOCUMENTS

| | | | | |
|---|---|---|---|---|
| 2003/0100345 | A1 | 5/2003 | Gum | |
| 2003/0187638 | A1* | 10/2003 | Causevic et al. | 704/226 |
| 2003/0236661 | A1* | 12/2003 | Burges et al. | 704/205 |
| 2005/0137871 | A1* | 6/2005 | Capman et al. | 704/268 |
| 2006/0095256 | A1* | 5/2006 | Nongpiur et al. | 704/207 |
| 2006/0116873 | A1* | 6/2006 | Hetherington et al. | 704/226 |
| 2006/0265210 | A1* | 11/2006 | Ramakrishnan et al. | 704/205 |
| 2007/0083362 | A1* | 4/2007 | Moriya et al. | 704/219 |
| 2007/0124140 | A1* | 5/2007 | Iser et al. | 704/223 |
| 2007/0198254 | A1* | 8/2007 | Goto et al. | 704/226 |
| 2007/0198255 | A1* | 8/2007 | Fingscheidt et al. | 704/228 |
| 2007/0225984 | A1* | 9/2007 | Milstein et al. | 704/270 |
| 2008/0052074 | A1* | 2/2008 | Gopinath et al. | 704/256 |
| 2008/0162134 | A1* | 7/2008 | Forbes et al. | 704/241 |
| 2008/0281589 | A1* | 11/2008 | Wang et al. | 704/226 |
| 2009/0055171 | A1* | 2/2009 | Zopf | 704/228 |
| 2009/0192791 | A1* | 7/2009 | El-Maleh et al. | 704/219 |
| 2009/0265167 | A1* | 10/2009 | Ehara et al. | 704/219 |
| 2009/0292536 | A1* | 11/2009 | Hetherington et al. | 704/225 |

OTHER PUBLICATIONS

Vary, P. et al., Chapter 6, "Linear Prediction," *Digital Speech Transmission: Enhancement, Coding and Error Concealment*, John Wiley & Sons, Ltd, Hoboken, NJ, USA, copyright 2006, pp. 163-199.

* cited by examiner

PARTIAL SPEECH RECONSTRUCTION

BACKGROUND OF THE INVENTION

1. Priority Claim

This application claims the benefit of priority from European Patent 07021121.4, filed Oct. 29, 2007, which is incorporated by reference.

2. Technical Field

This disclosure relates to verbal communication and in particular to signal reconstruction.

3. Related Art

Mobile communications may use networks of transmitter to convey telephone calls from one destination to another. The quality of these calls may suffer from the naturally occurring or system generated interference that degrades the quality or performance of the communication channels. The interference and noise may affect the conversion of words into a machine readable input.

Some systems attempt to improve speech quality by only suppressing noise. Since the noise is not entirely eliminated, intelligibility may not sufficiently improve. Low signal-to-noise ratios may not be detected by some speech recognition systems. Therefore, there is a need for a system to improve intelligibility in communication systems.

SUMMARY

A system enhances the quality of a digital speech signal that may include noise. The system identifies vocal expressions that correspond to the digital speech signal. A signal-to-noise ratio of the digital speech signal is measured before a portion of the digital speech signal is synthesized. The selected portion of the digital signal may have a signal-to-noise ratio below a predetermined level and the synthesis may be based on speaker identification.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Systems may transmit, store, manipulate, and synthesize speech. Some systems identify speakers by comparing speech represented in digital formats. Based on power levels, a system may synthesize a portion of a digital speech signal. The power levels may be below a programmable threshold. The system may convert portions of the digital speech signal into aural signals based on speaker identification.

Figure 1:
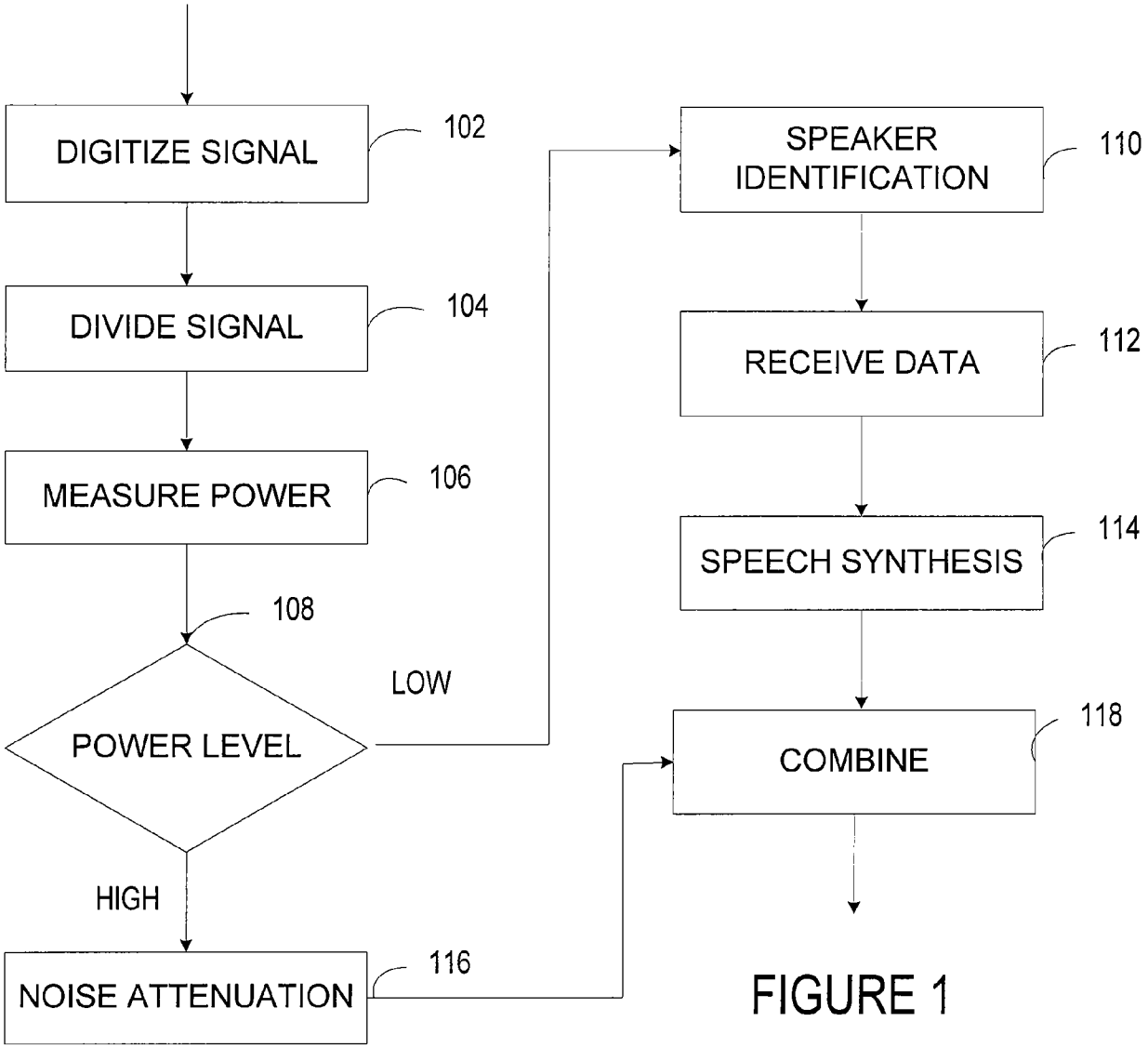
FIG. 1 is a method that enhances speech quality.

One or more sensors or input devices may convert sound into an analog signal or digital data stream 102 (in FIG. 1). A microphone or input array (e.g., a microphone array) may receive the input sounds that are converted into operational signals that correspond to a speaker's vocal expressions. A controller or processor may separate the operational signals into frequency bins or sub-bands (at optional 104) before calculating or estimating the respective power levels at 106 (e.g., signal-to-noise ratio of each bin or sub-band). Sub-band signals exhibiting a noise level above a threshold may be synthesized (reconstructed). The power level or signal-to-noise ratio (SNR) may be a ratio of the squared magnitude of a short-time spectrum of a speech signal and the estimated power density spectrum of a background noise detected or present in the speech signal.

A partial speech synthesis at 114 may be based on an identification of the speaker at 110. Speaker-dependent data at 112 may be processed during the synthesis that includes significant noise levels. The speaker-dependent data may comprise one or more pitch pulse prototypes (e.g., samples) and spectral envelopes. The samples and envelopes may be extracted from a current speech signal, a previous speech signal, or retrieved from a local or remote central or distributed database. Cepstral coefficients, line spectral frequencies, and/or speaker-dependent features may also be processed.

In some systems portions of a digital speech signal having power levels greater than a predetermined level or within a range are filtered at 116. The filter may selectively pass content or speech while attenuating, dampening, or minimizing noise. The selected signal and portions of the synthesized digital speech signal may be adaptively combined at 118. The combination and selected filtering may be based on a measured SNR. If the SNR (e.g., in a frequency sub-band) is sufficiently high, a predetermined pass-band and/or attenuation level may be selected and applied.

Some systems may minimize artifacts by combining only filtered and synthesized signals. The entire digital speech signal may be filtered or processed. A Wiener filter may estimate the noise contributions of the entire signal by processing each bin and sub-band. A speech synthesizer may process the relatively noisy signal portions. The combination of synthesized and filtered signal may be adapted based on a predetermined SNR level.

When the signal-to-noise ratio of one or more segments of a digital speech signal falls below (or is below) a threshold (e.g., a predetermined level), the segment(s) may be synthesized through one or more pitch pulse prototypes (or models) and spectral envelopes. The pitch pulse prototypes and envelopes may be derived from an identified speech segment. In some systems, a pitch pulse prototype represents an obtained excitation signal (spectrum) that represents the signal that would be detected near the vocal chords or a vocal tract of the identified speaker. The (short-term) spectral envelope may represent the tone color. Some systems calculate a predictive error filter through a Linear Predictive Coding (LPC) method. The coefficients of the predictive error filter may be applied or processed to parametrically determine the spectral envelope. In an alternative system, spectral envelope models are processed based on line spectral frequencies, cepstral coefficients, and/or mel-frequency cepstral coefficients.

A pitch pulse prototype and/or spectral envelope may be extracted from a speech signal or a previously analyzed speech signal obtained from a common speaker. A codebook database may retain spectral envelopes associated or trained by the identified speaker. The spectral envelope $E(e^{j\Omega_\mu},n)$ may, be obtained by $$E(e^{j\Omega_\mu},n)=F(SNR(\Omega_\mu,n))E_s(e^{j\Omega_\mu},n)+[1-F(SNR(\Omega_\mu,n))]E_{cb}(e^{j\Omega_\mu},n)$$

where $E_s(e^{j\Omega_\mu},n)$ and $E_{cb}(e^{j\Omega_\mu},n)$ are an extracted spectral envelope and a stored codebook envelope, respectively, and $F(SNR(\Omega_\mu,n))$ denotes a linear mapping function.

By a mapping function, the spectral envelope $E(e^{j\Omega_\mu}, n)$ may be generated by adaptively combining the extracted spectral envelope and the codebook envelope based on an actual or estimated SNR in the sub-bands $\Omega_\mu$. For example, F=1 for an SNR that exceeds some predetermined level and a small (<<1) real number for a low SNR (below the predetermined level). Thus, for those portions of signals that do not render a reliable estimate of a spectral envelope, a codebook spectral envelope may be selected and processed to synthesize a portion of speech. In some systems, portions of the filtered speech signal may be delayed before the signal is combined with one or more synthesized portions. The delay may compensate for processing delays that may be caused by the signal processor's synthesis.

In some systems one or more portions of the synthesized speech signal may be filtered. The filter may comprise a window function that selectively passes certain elements of the signal before the elements are combined with one or more filtered portions of the speech signal. A windowing functions like a Hann window or a Hamming window, for example, may adapt the power of the filtered synthesized speech signal to that of the noise reduced signal parts. The function may smooth portions of the signal. In some applications the smoothed portions may be near one or more edges of a current signal frame.

Some systems identify speakers through speaker models. A speaker model may include a stochastic speaker model that may be trained by a known speaker on-line or off-line. Some stochastic speech models include Gaussian mixture models (GMM) and Hidden Markov Models (HMM). If an unknown speaker is identified, on-line training may generate a new speaker-dependent model. Some on-line training generates high-quality feature samples (e.g., pitch pulse prototypes, spectral envelopes etc.) when the training occurs under controlled conditions and when speaker is identified within a high confidence interval.

In those instances when speaker identification is not complete or a speaker is unknown, the speaker-independent data (e.g., pitch pulse prototypes, spectral envelopes, etc.) may be processed to partially synthesize speech. An analysis of the speech signal from an unknown speaker may extract new pitch pulse prototypes and spectral envelopes. The prototypes and envelopes may be assigned to the previously unknown speaker for future identification (e.g., during processing within a common session or whenever processing vocal expressions from that speaker).

When retained in a computer readable storage medium the process may comprise computer-executable instructions. The instructions may identify a speaker whose vocal expressions correspond to a digital speech signal. A speech input 202 of FIG. 2 (e.g., one or more inputs and a beamformer controller) may be configured to detect the vocal expression and measure the power (e.g., signal-to-noise ratio) of the digital speech signal. One or more signal processors (or controllers) 204 and 206 may be programmed to synthesize a portion of the digital speech signal when the power level in a portion of the signal is below a predetermined level and filter a portion of the speech signal when the power level in a portion of the signal is greater than a predetermined level. The synthesis may be based on speaker identification.

Figure 3:
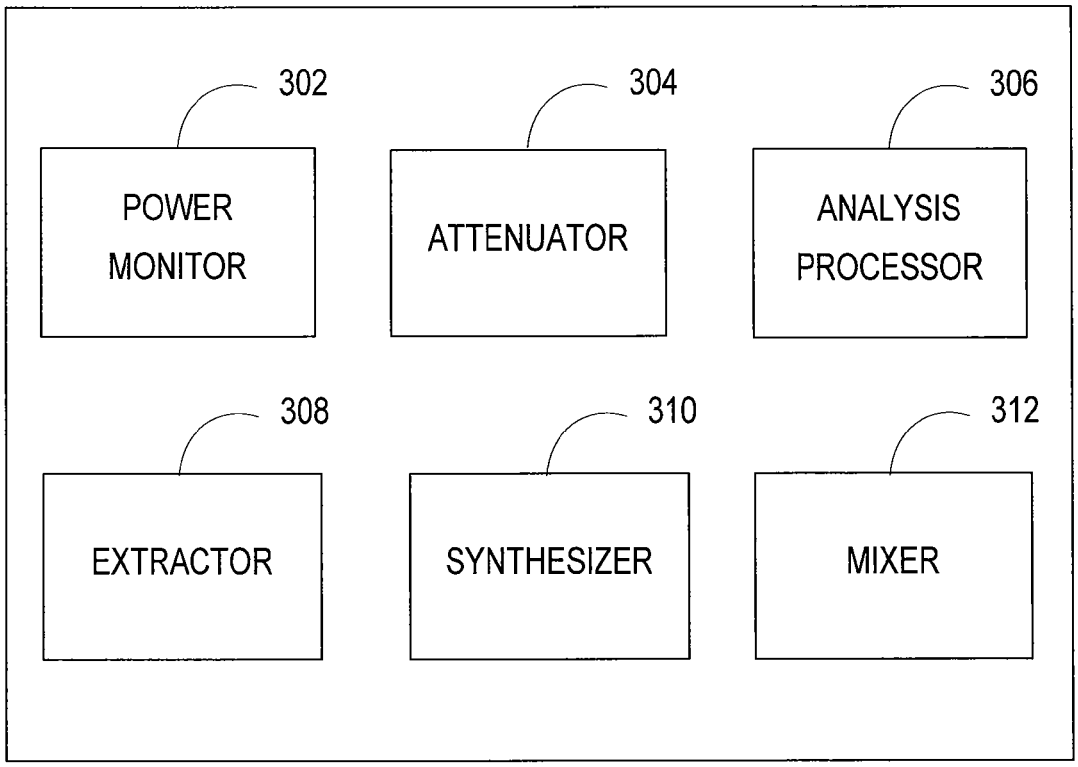
FIG. 3 is an alternate system that enhances speech quality.

The alternative system of FIG. 3 may enhance the quality of a digital speech signal that may contain noise. The system may include hardware and/or software that may measure or estimate a signal-to-noise ratio of a digital speech signal (e.g., a signal or power monitor) 302. Some hardware and/or software may selectively pass certain elements of the digital speech signal while attenuating (e.g., dampening) or minimizing noise (e.g., a filter) 304. An analysis processor 306 is programmed or configured to classify a speech signal into voiced and/or unvoiced classes. The analysis processor 306 may estimate the pitch frequency and the spectral envelope of the digital speech signal and may identify a speaker whose vocal expression corresponds to the digital speech signal. An extractor 308 may extract a pitch pulse prototype from the digital speech signal or access and retrieve a pitch pulse prototype from a local or remote or a central or distributed database. A synthesizer 310 synthesizes some of the digital speech signal based on the voiced and unvoiced classification. The synthesis may be based on an estimated pitch frequency, a spectral envelope, a pitch pulse prototype and/or the identification of the speaker. A mixer 312 may mix the synthesized portion of the digital speech signal and the noise reduced digital speech signal based on the determined signal-to-noise ratio of the digital speech signal.

The analysis processor 306 may comprise separate physical or logical units or may be a unitary device (that may keep power consumption low). The analysis processor 306 may be configured to process digital signals in a sub-band regime (which allows for very efficient processing). The processor 306 may interface or include an optional analysis filter bank that applies a Hann window that divides the digital speech signal into sub-band signals. The processor 306 may interface or include an optional synthesis filter bank (that may apply the same window function as an analysis filter bank that may be part of or interface the analysis processor 306). The synthesis filter bank may synthesize some or all of the sub-band signals that are processed by the mixer 312 to obtain an enhanced digital speech signal.

Some alternative systems may include or interface a delay device and/or a filter that applies window functions. The delay device may be programmed or configured to delay the noise reduced digital speech signal. The window function may filter the synthesized portion of the digital speech signal. Some alternative systems may further include a local or remote central or distributed codebook database that retains speaker-dependent or speaker-independent spectral envelopes. The synthesizer 310 may be programmed or configured to synthesize some of the digital speech signal based on a spectral envelope accessed from the codebook database. In some applications, the synthesizer 310 may be configured or programmed to combine spectral envelopes that were estimated from the digital speech signal and retrieved from the codebook database. A combination may be formed through a linear mapping.

Figure 4:
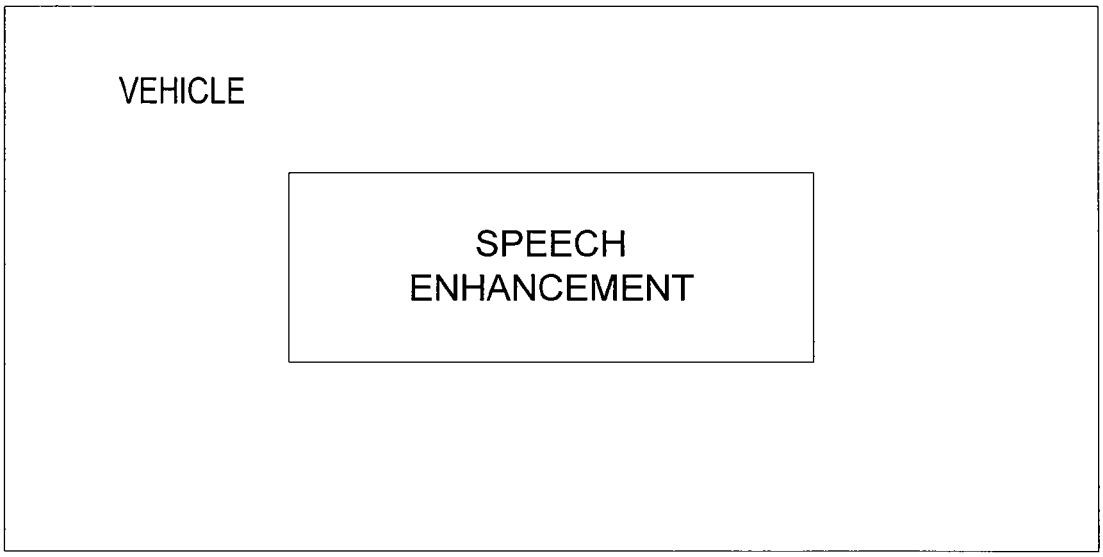
FIG. 4 is an in-vehicle system that interfaces a speech enhancement system.
Figure 5:
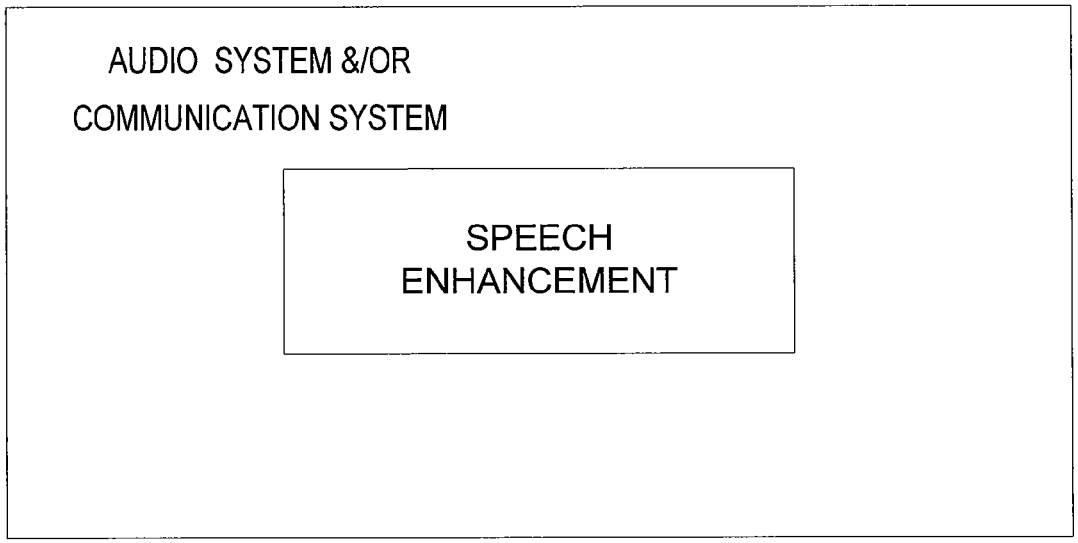
FIG. 5 is an audio and/or communication system that interfaces a speech enhancement system.

Some systems may include or interface an identification database. The identification database may retain training data that may identify a speaker. The analysis processor 306 in this system and the systems described above may be programmed or configured to identify the speaker by processing or generating a stochastic speech model. In the alternative systems (including those described) may interface or include a database that retains speaker-independent data (as, e.g., speaker-independent pitch pulse prototypes) that may facilitate speech synthesis when identification is incomplete or identification has failed. Each of the systems and alternatives described may process and convert one or more signals into a mediated verbal communication. The systems may interface or may be part of an in-vehicle (FIG. 4) or out-of-vehicle communication or audio systems (FIG. 5). In some applications the systems are a unitary part of a hands-free communication system, a speech recognition system, a speech control system, or other systems that may receive and/or process speech.

Figure 6:
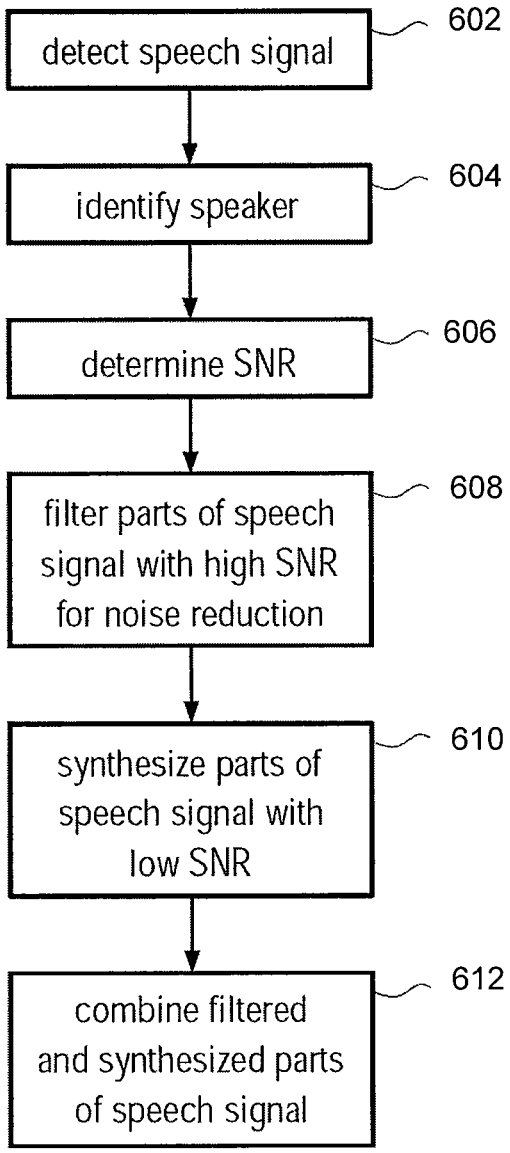
FIG. 6 is an alternate method that enhances speech quality.

FIG. 6 is a method that enhances speech quality. The method detects a speech signal 602 that may represent a speaker's vocal expressions. The process identifies the speaker 604 through an analysis of the (e.g., digitized) voiced and/or unvoiced input. A speaker may be identified by processing text dependent and/or text independent training data. Some methods generate or process stochastic speech models (e.g., Gaussian mixture models (GMM), Hidden Markov Models (HMM)), apply artificial neural networks, radial base functions (RBF), Support Vector Machines (SVM), etc. Some methods sample and process speech data at 602 to train the process and/or identify a user. The speech samples may be stored and compared with previously trained data to identify speakers. Speaker identification may occur through the processes and systems described in co-pending U.S. patent application Ser. No. 12/249,089, which is incorporated by reference.

Speakers may be identified in noisy environments (e.g., within vehicles). Some systems may assign a pitch pulse prototype to users that speak in noisy environments. In some processes one or more stochastic speaker-independent speech models (e.g., a GMM) may be trained by two or more different speakers articulating two or more different utterances (e.g., through a k-means or expectation maximization (EM) algorithm)). A speaker-independent model such as a Universal Background Model may be adapted or serve as a template for some speaker-dependent models. A speech signal articulated in a low-perturbed environment and exclusive noisy backgrounds (without speech) may be stored in a local or remote centrally located or distributed database. The stored representations may facilitate a statistical modeling of noise influences on speech (characteristics and/or features). Through this retention, the process may account for or compensate for the influence noise may have on some or all selected speech segments. In some processes the data may affect the extraction of feature vectors that may be processed to generate a spectral envelope.

Unperturbed feature vectors may be estimated from perturbed feature vectors by processing data associated with background noise. The data may represent the noise detected in vehicle cabins that may correspond to different speeds, interior and/or exterior climate conditions, road conditions, etc. Unperturbed speech samples of a Universal Background Model may be modified by noise signals (or modifications associated or assigned to them) and the relationships of unperturbed and perturbed features of the speech signals may be monitored and stored on or off-line. Data representing statistical relationships may be further processed when estimating feature vectors (and, e.g., the spectral envelope). In some processes, heavily perturbed low-frequency parts of processed speech signals may be removed or deleted during training and/or through the enhancement process of FIG. 6. The removal of the frequency range may restrict the training corpora and the signal enhancement to reliable information.

In FIG. 6, the power spectrum (or signal-to-noise ratio (SNR)) of the speech signal is measured or estimated at 606. Power may be measured through a noise filter such as a Wiener filter, for example. A SNR may be determined through the squared magnitude of the short time spectrum and the estimated noise power density spectrum.

For a relatively high SNR, some noise reduction filter may enhance the quality of speech signals. Under highly perturbed conditions, the same noise reduction filter may not be as effective. Because of this condition, the process may determine or estimate which parts of the detected speech signal exhibit an SNR below a predetermined or pre-programmed SNR level (e.g. below 3 dB) and which parts exhibit an SNR that exceeds that level. Those parts of the speech signal with relatively low perturbations (SNR above the predetermined level) are filtered at 608 by some a noise reduction filter. The filter may comprise a Wiener filter. Those portions of the speech signal with relatively high perturbations (SNR below the predetermined level) may be synthesized (or reconstructed) at 610 before the signal is combined with the filtered portions at 612.

The system that synthesizes the speech signal exhibiting high perturbations may access and process speaker-dependent pitch pulse prototypes retained in a database. When speaker is identified at 604, associated pitch pulse prototypes (that may comprise the long-term correlations) may be retrieved and combined with spectral envelopes (that may comprise short term correlations) to synthesize speech. In an alternative process, the pitch pulse prototypes may be extracted from a speaker's vocal expression, in particular, from utterances subject to relatively low perturbations.

To reliably extract some pitch pulse prototypes, the average SNR may be sufficiently high for a frequency that ranges from the speaker's average pitch frequency to a level that's about five to about ten times that frequency. The current pitch frequency may be estimated with sufficient accuracy. In addition, a suitable spectral distance measure may be made by e.g., $$\Delta(Y(e^{j\Omega_\mu}, n), Y(e^{j\Omega_\mu}, m)) = \sum_{\mu=0}^{M/2-1} \left|10\log_{10}\{|Y(e^{j\Omega_\mu}, n)|^2\} - 10\log_{10}\{|Y(e^{j\Omega_\mu}, m)|^2\}\right|^2$$

where $Y(e^{j\Omega_\mu}, m)$ denotes a digitized sub-band speech signal at time m for the frequency sub-band $\Omega_\mu$ (the imaginary unit is denoted by j), that may show only a slight spectral variations among the individual signal frames in about the last five to six signal frames.

When these conditions are satisfied, the spectral envelope may be extracted and stripped from the speech signal (consisting of L sub-frames) through a predictive error filtering, for example. The pitch pulse that is located closest to a middle or a selected frame, may be shifted so that it is positioned exactly or near the middle of the frame. In some processes, a Hann window may be overlaid across the frame. The spectrum of a speaker-dependent pitch pulse prototype may be obtained through a Discrete Fourier Transform and power normalization.

When a speaker is identified and if the environmental conditions allow for a precise estimate of a new pitch impulse, some processes extract two or more (e.g., a variety) speaker-dependent pitch pulse prototypes for different pitch frequencies. When synthesizing portion of the speech signal, a selected pitch pulse prototype may be processed that has a fundamental frequency substantially near the current estimated pitch frequency. When a number (e.g., predetermined number) of the extracted pitch pulses prototypes differ from those stored by a predetermined measure, one or more of the extracted pitch pulses prototypes may be written to memory (or a database) to replace the previously stored prototype. Through this dynamic refresh process or cycle, the process may renew the prototypes with more accurate representations. A reliable speech synthesis may be sustained even under atypical conditions that may cause undesired or outlier pitch pulses to be retained in memory (or the database).

At 612, the synthesized and noise reduced portions of the speech signal are combined. The result or enhanced speech signal may be generated or received by an in-vehicle or out-of-vehicle system. The system may comprise a navigation system interfaced to a structure for transporting persons or things (e.g., a vehicle shown in FIG. 4), interface a communication (e.g., wireless system) or audio system (shown in FIG. 5) or may provide speech control for mechanical, electrical, or electromechanical devices or processes.

Figure 7:
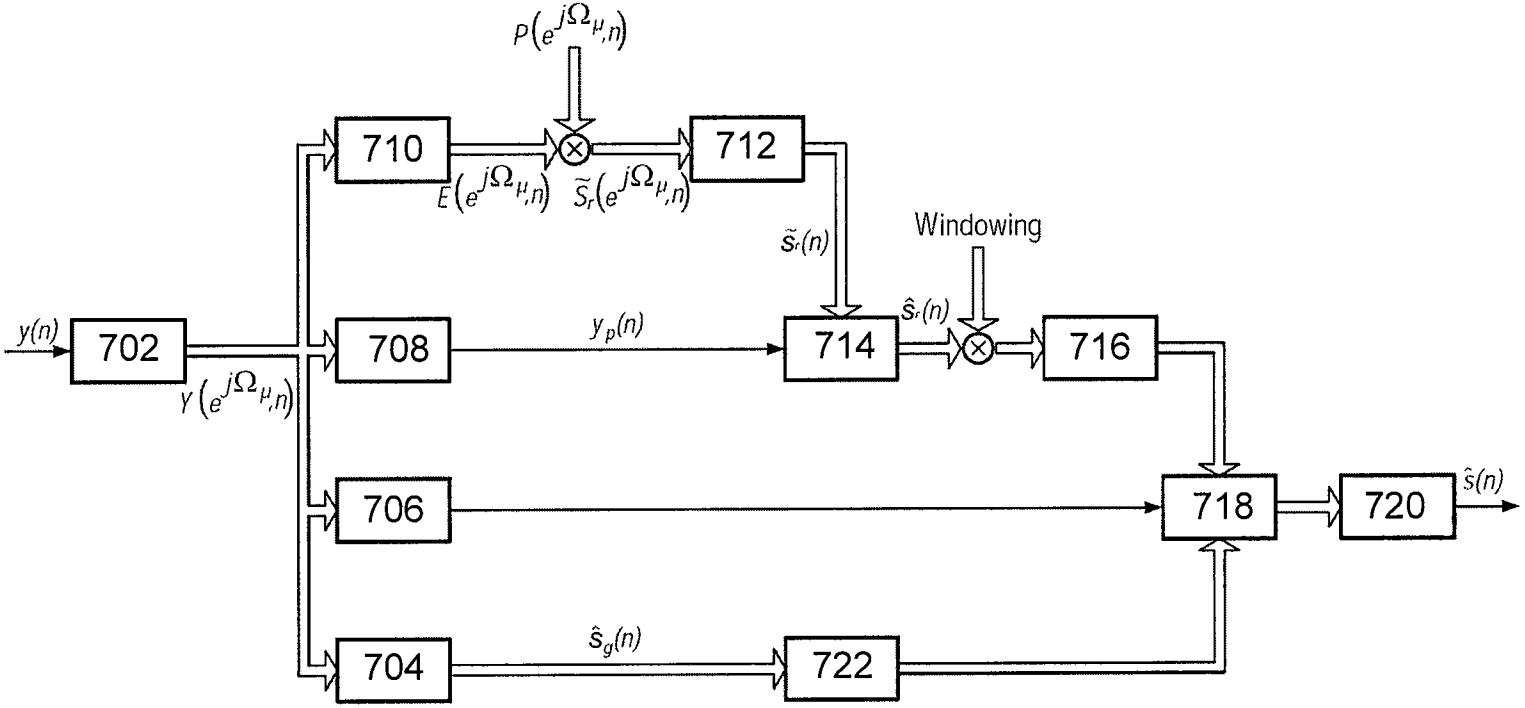
FIG. 7 is an alternate system that enhances speech quality.

FIG. 7 is a system that improves speech quality. The system may detect and digitize a speech signal (a digitized input such as a microphone signal or sensor input). y(n) is divided into sub-band signals $Y(e^{j\Omega_\mu},n)$ through an analysis filter bank 702. The analysis filter bank 702 may comprise Hann or Hamming windows, for example, that may have a length of about 256 frequency sub-bands. The sub-band signals $Y(e^{j\Omega_\mu},n)$ may be processed by a noise reduction filter 704 that renders a noise reduced speech signal $\hat{s}_g(n)$ (the estimated unperturbed speech signal). In some systems, the noise reduction filter 704 may determine or estimate the power level or SNR in each frequency $\Omega_\mu$ sub-band. The measure or estimate may be based on an estimated power density spectrum of the background noise and the perturbed sub-band speech signals.

A classifier 706 may discriminate the signal segments that display a noise-like structure (an unvoiced portion in which no periodicity may be apparent) and a quasi-periodic segment (a voiced portion) of the speech sub-band signals. A pitch estimator 708 may estimate the pitch frequency $f_p(n)$. The pitch frequency $f_p(n)$ may be estimated through an autocorrelation analysis, cepstral analysis, etc. A spectral envelope detector 710 may estimate the spectral envelope $E(e^{j\Omega_\mu},n)$. The estimated spectral envelope $E(e^{j\Omega_\mu},n)$ may be folded with an appropriate pitch pulse prototype through an excitation spectrum $P(e^{j\Omega_\mu},n)$ that may extracted from the speech signal y(n) or retrieved from the central or distributed database.

The excitation spectrum $P(e^{j\Omega_\mu},n)$ may represent the signal that would be detected at the vocal tract (e.g., substantially near the vocal chords). The appropriate excitation spectrum $P(e^{j\Omega_\mu},n)$ may be compared to the spectrum of the identified speaker whose utterance is represented by signal y(n). A folding procedure results in the spectrum $\tilde{S}_r(e^{j\Omega_\mu},n)$ that is transformed in the time domain by an Inverse Fast Fourier Transformer or converter 712 through:

$$\tilde{s}_r(m,n) = \frac{1}{M}\sum_{\mu=0}^{M-1} \tilde{S}_r(e^{j\Omega_\mu}, n)e^{j\frac{2\pi}{M}\mu m}$$

where m denotes a time instant in a current signal frame n. For each frame signal synthesis is performed by a synthesizer 714 wherever (within the frame) a pitch frequency is determined to obtain the synthesis signal vector $\hat{s}_r(n)$. Transitions from voiced ($f_p$ determined) to unvoiced portions may be smoothed to avoid artifacts. The synthesis signal $\hat{s}_r(n)$ may be multiplied (e.g., a multiplier) by the same window function that was applied by the analysis filter bank 702 to adapt the power of both the synthesis and noise reduced signals $\hat{s}_g(n)$ and $\hat{s}_r(n)$.

After the signal is transformed to the frequency domain through a Fast Fourier Transformer or controller 716 the synthesis signal $\hat{s}_r(n)$ and the time delayed noise reduced signal $\hat{s}_g(n)$ are adaptively mixed by mixer 718. Delay is introduced in the noise reduction path by a delay unit (or delayer) 722 to compensate for the processing delay in the upper branch of FIG. 7 that generates the synthesis signal $\hat{s}_r(n)$. The mixing in the frequency domain by mixer 718 may combine the signals such that synthesized parts are used for sub-bands exhibiting a SNR below a predetermined level and noise reduced parts are used for sub-bands with an SNR above this level. The respective estimation of the SNR may be generated by the noise reduction filter 704. If the classifier 706 does not detect a voiced signal segment, mixer 718 outputs the noise reduced signal $\hat{s}_g(n)$. The mixed sub-band signals are synthesized by a synthesis filter bank 720 to obtain the enhanced full-band speech signal in the time domain $\hat{s}_n(n)$.

Figure 8:
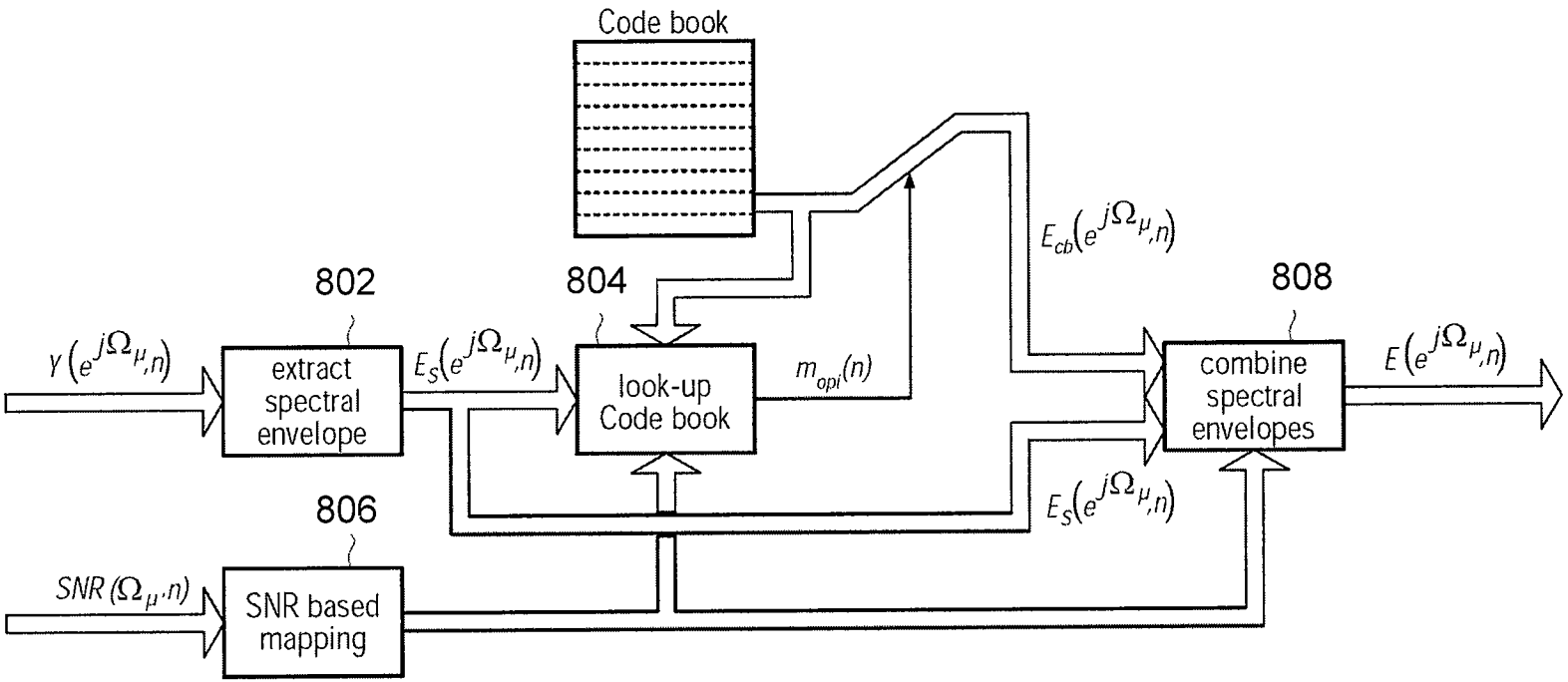
FIG. 8 is a system that estimates a spectral envelope.

The excitation signal may be shaped with the estimated spectral envelope. In FIG. 8 a spectral envelope $E_s(e^{j\Omega_\mu},n)$ is extracted at 802 from the sub-band speech signals $Y(e^{j\Omega_\mu},n)$. The extraction of the spectral envelope $E_s(e^{j\Omega_\mu},n)$, for example, may be performed through a linear predictive coding (LPC) or cepstral analysis. For a relatively high SNR good estimates for the spectral envelope may be obtained. For signal portions sub-bands exhibiting a low SNR a codebook comprising previously trained samples of spectral envelopes may be accessed 804 to find an entry in the codebook that best matches a spectral envelope extracted for a signal portion sub-band with a high SNR.

Figure 2:
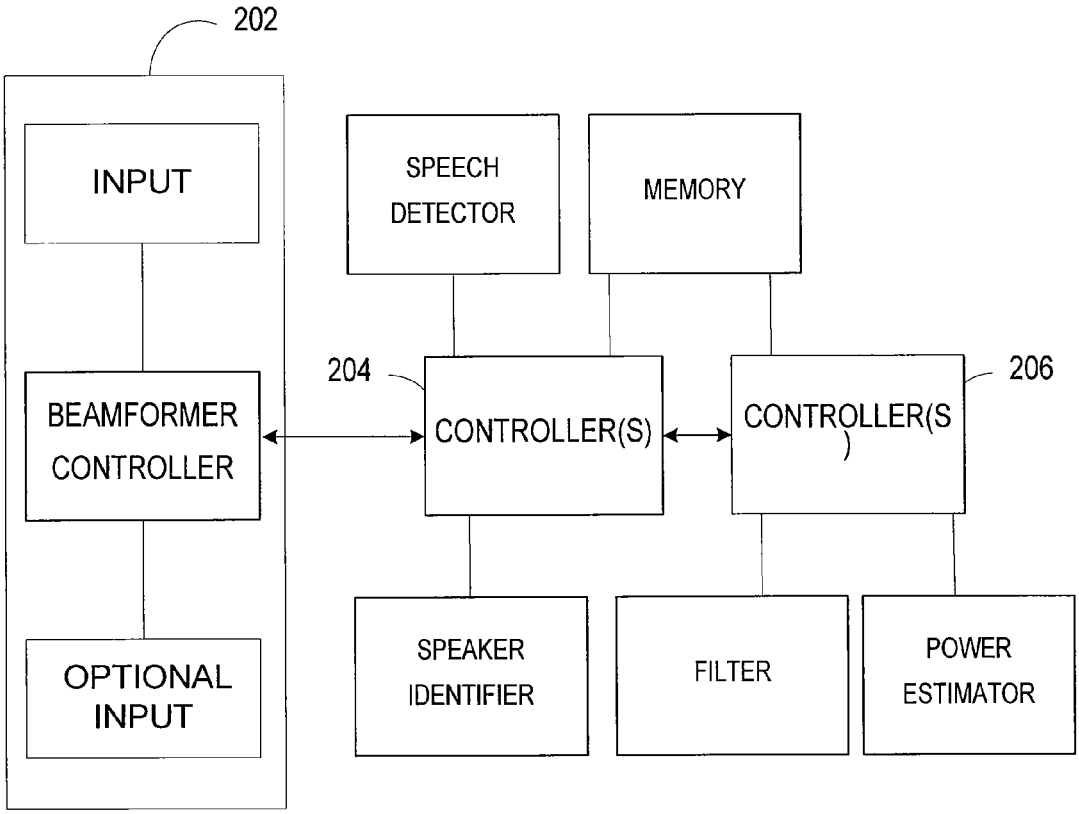
FIG. 2 is a system that enhances speech quality.

Based on the SNR determined by the noise reduction filter 704 of FIG. 2 (or a logically or physically separate unit) the extracted spectral envelope $E_s(e^{j\Omega_\mu},n)$ or an appropriate one retrieved spectral envelope from the codebook $E_{cb}(e^{j\Omega_\mu},n)$ (after adaptation of power) may be processed. A linear mapping (masking) 806 may be processed to control the choice of spectral envelopes according to $$F(SNR(\Omega_\mu, n)) = \begin{cases} 1, \text{ if } SNR(\Omega_\mu, n) > & SNR_0 \\ 0.001, & \text{else} \end{cases}$$

where $SNR_0$ denotes a suitable predetermined level with which the current SNR of a signal (portion) is compared.

The extracted spectral envelope $E_s(e^{j\Omega_\mu},n)$ and the spectral envelope retrieved from the codebook $E_{cb}(e^{j\Omega_\mu},n)$ are combined 808 through the linear mapping function described above. The combination generates a spectral envelope $E(e^{j\Omega_\mu},n)$ that synthesizes speech through a pitch pulse prototype $P(e^{j\Omega_\mu},n)$ as shown in FIG. 2:

$$E(e^{j\Omega_\mu},n)=F(SNR(\Omega_\mu,n))E_s(e^{j\Omega_\mu},n)+[1-F(SNR(\Omega_\mu,n))]E_{cb}(e^{j\Omega_\mu}n,).$$

In the above examples, speaker-dependent data may be processed to partially synthesize speech. In some applications speaker identification may be difficult in noisy environments and reliable identification may not occur with the speaker's first utterance. In some alternative systems, speaker-independent data (pitch pulse prototypes, spectral envelopes) may be processed (in these conditions) to partially reconstruct a detected speech signal until the current speaker is or may be identified. After successful identification, the systems may continue to process speaker-dependent data.

While signals are processed in each time frame, speaker-dependent features may be extracted from the speech signal and may be compared with stored features. By this comparison, some or all of the extracted speaker-dependent features may replace the previously stored features (e.g., data). This process may occur under many conditions including environments subject to a higher level of transient or background noise. Other alternate systems and methods may include combinations of some or all of the structure and functions described above or shown in one or more or each of the figures. These systems or methods are formed from any combination of structures and function described or illustrated within the figures.

The methods, systems, and descriptions above may be encoded in a signal bearing medium, a computer readable medium or a computer readable storage medium such as a memory that may comprise unitary or separate logic, programmed within a device such as one or more integrated circuits, or processed by a controller or a computer. If the methods or descriptions are performed by software, the software or logic may reside in a memory resident to or interfaced to one or more processors, digital signal processors, or controllers, a communication interface, a wireless system, a powertrain controller, body control module, an entertainment and/or comfort controller of a vehicle, a non-vehicle system or non-volatile or volatile memory remote from or resident to the a speech recognition device or processor. The memory may retain an ordered listing of executable instructions for implementing logical functions. A logical function may be implemented through digital circuitry, through source code, through analog circuitry, or through an analog source such as through an analog electrical, or audio signals.

The software may be embodied in any computer-readable storage medium or signal-bearing medium, for use by, or in connection with an instruction executable system or apparatus resident to a vehicle or a hands-free or wireless communication system. Alternatively, the software may be embodied in a navigation system or media players (including portable media players) and/or recorders. Such a system may include a computer-based system, a processor-containing system that includes an input and output interface that may communicate with an automotive, vehicle, or wireless communication bus through any hardwired or wireless automotive communication protocol, combinations, or other hardwired or wireless communication protocols to a local or remote destination, server, or cluster.

A computer-readable medium, machine-readable storage medium, propagated-signal medium, and/or signal-bearing medium may comprise any medium that contains, stores, communicates, propagates, or transports software for use by or in connection with an instruction executable system, apparatus, or device. The machine-readable storage medium may selectively be, but not limited to, an electronic, magnetic, optical, electromagnetic, infrared, or semiconductor system, apparatus, device, or propagation medium. A non-exhaustive list of examples of a machine-readable medium would include: an electrical or tangible connection having one or more links, a portable magnetic or optical disk, a volatile memory such as a Random Access Memory "RAM" (electronic), a Read-Only Memory "ROM," an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled by a controller, and/or interpreted or otherwise processed. The processed medium may then be stored in a local or remote computer and/or a machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method that enhances the quality of a digital speech signal including noise, comprising:

identifying the speaker whose utterance corresponds to the digital speech signal;

determining a signal-to-noise ratio of the digital speech signal; and synthesizing a portion of the digital speech signal for which the determined signal-to-noise ratio is below an intelligible level, wherein synthesizing the portion is based, in part, on the identification of the speaker, wherein synthesizing the portion is by processing a pitch pulse prototype and a spectral envelope associated with the identified speaker, and wherein the spectral envelope is retrieved from a codebook database retaining spectral envelopes trained by the identified speaker.

2. The method of claim 1 further comprising:

filtering at least parts of the digital speech signal for which the determined signal-to-noise ratio exceeds the intelligible level; and combining the filtered parts of the digital speech signal with the portion of the synthesized digital speech signal to obtain an enhanced digital speech signal.

3. The method of claims 2 further comprising:

delaying the portion of the digital speech signal filtered before combining the filtered parts of the digital speech signal with the synthesized portion of the digital speech signal to obtain the enhanced digital speech signal.

4. The method of claim 1 where the pitch pulse prototype is retrieved from a database that retains a pitch pulse prototype for the identified speaker.

5. The method of claim 1 where the pitch pulse prototype is retrieved from a distributed database that retains a pitch pulse prototype for the identified speaker.

6. The method of claim 1 where a spectral envelope is extracted from the digital speech signal.

7. The method of claim 1 further comprising multiplying the synthesized portion of the digital speech signal with a windowing function before combining the filtered parts of the digital speech signal with the synthesized portion of the digital speech signal to obtain the enhanced digital speech signal.

8. The method of claim 1 further comprising delaying the portion of the digital speech signal filtered before combining the filtered parts of the digital speech signal with the synthesized portion of the digital speech signal to obtain the enhanced digital speech signal.

9. The method of claim 1 where the spectral envelope $E(e^{j\Omega_\mu},n)$ is obtained by $$E(e^{j\Omega_\mu},n)=F(SNR(\Omega_\mu,n))E_S(e^{j\Omega_\mu},n)+[1-F(SNR(\Omega_\mu,n))]E_{cb}(e^{j\Omega_\mu},n)$$

where $E_S(e^{j\Omega_\mu},n)$ and $E_{cb}(e^{j\Omega_\mu},n)$ comprises an extracted spectral envelope and a codebook envelope, respectively, and $F(SNR(\Omega_\mu,n))$ comprises a linear mapping function.

10. The method of claim 1 where a portion of the digital speech signal for which the signal-to-noise ratio is below the intelligible level is synthesized by processing a pitch pulse prototype and the spectral envelope associated with the identified speaker.

11. The method of claim 1 where the act of identifying the speaker is based on speaker independent models.

12. The method of claim 1 where the act of identifying the speaker is based on processing stochastic speech models trained during utterances of an identified speaker.

13. The method of claim 1 further comprising dividing the digital speech signal into sub-bands to render sub-band signals and where the signal-to-noise ratio is determined for each sub-band and sub-band signals are synthesized that exhibit a signal-to-noise ratio below the intelligible level.

14. A non-transitory computer-readable storage medium that stores instructions that, when executed by processor, causes the processor to reconstruct or mix speech by executing software that causes the following act comprising:

identifying the speaker whose utterance corresponds to the digital speech signal; digitizing a speech signal representing a verbal utterance;

determining a signal-to-noise ratio of the digital speech signal; synthesizing a portion of the digital speech signal for which the determined signal-to-noise ratio is below an intelligible level based on the identification of the speaker filtering at least parts of the digital speech signal for which the determined signal-to-noise ratio exceeds the intelligible level; and combining the filtered parts of the digital speech signal with the portion of the synthesized digital speech signal to obtain an enhanced digital speech signal by processing a pitch pulse prototype and a spectral envelope associated with the identified speaker, wherein the spectral envelope is retrieved from a codebook database retaining spectral envelopes trained by the identified speaker.

15. A signal processor that enhances the quality of a digital speech signal including noise, comprising:

a noise reduction filter configured to determine a signal-to-noise ratio of a digital speech signal and to filter the digital speech signal to obtain a noise reduced digital speech signal;

an analysis processor programmed to classify the digital speech signal into a voiced portion and an unvoiced portion, to estimate a pitch frequency and a spectral envelope of the digital speech signal and to identify a speaker whose utterance corresponds to the digital speech signal, wherein the spectral envelope is retrieved from a codebook database retaining spectral envelopes trained by the identified speaker;

an extractor configured to extract a pitch pulse prototype from the digital speech signal or to retrieve a pitch pulse prototype from a database;

a synthesizer configured to synthesize a portion of the digital speech signal based on the voiced classification having a signal to noise ratio below an intelligible threshold, the estimated pitch frequency, the spectral envelope, the pitch pulse prototype, and an identification of the speaker; and a mixer configured to mix the synthesized portion of the digital speech signal and the noise reduced digital speech signal based on the determined signal-to-noise ratio of the digital speech signal.

16. The signal processor of claim 15 further comprising an analysis filter bank configured to divide the digital speech signal into sub-band signals and a synthesis filter bank configured to synthesize sub-band signals obtained by the mixer to obtain an enhanced digital speech signal.

17. The signal processor of claim 15 further comprising a delay device configured to delay the noise reduced digital speech signal.

18. The signal processor of claim 15 further comprising a multiplier configured to multiply the synthesized portion of the digital speech signal with a window function.

19. The signal processor of claim 15 where the synthesizer is configured to synthesize the portion of the digital speech signal based on a spectral envelope stored in the codebook database.

20. The signal processor of claim 15 further comprising an identification database comprising training data associated with the identity of the speaker and where the analysis processor is programmed to identify the speaker by processing a stochastic speaker model.

21. The signal processor of claim 15 where the analysis processor is programmed to communicate with a hands-free device.

22. The signal processor of claim 15 where the analysis processor is programmed to communicate with a speech recognition device.

23. The signal processor of claim 15 where the analysis processor comprises a unitary part of a mobile phone.

* * * * *